United States Patent [19]

Morrone, III

[11] Patent Number: 4,474,043

[45] Date of Patent: Oct. 2, 1984

[54] ADJUSTABLE SPLIT-RING KEY TAG

[75] Inventor: Joseph A. Morrone, III, Westerly, R.I.

[73] Assignee: Adecon, Inc., Warwick, R.I.

[21] Appl. No.: 407,271

[22] Filed: Aug. 9, 1982

[51] Int. Cl.[3] ..... A47G 29/10

[52] U.S. Cl. ..... 70/456 R; 70/459

[58] Field of Search ..... 70/456 R, 456 B, 457, 70/458, 459; 24/3 K, 230.5 R, 230.5 AD

[56] References Cited

U.S. PATENT DOCUMENTS

| | | | |
|---|---|---|---|
| 438,097 | 10/1890 | Colton | 70/456 R |
| 4,309,883 | 1/1982 | Brentini | 70/456 R |
| 4,429,557 | 2/1984 | Morrone | 70/456 R |

*Primary Examiner*—Robert L. Wolfe

*Attorney, Agent, or Firm*—Salter & Michaelson

[57] ABSTRACT

A holder for keys and the like comprising a pair of plates which are disposed in laterally slidable abutting relation and which have ring portions which define normally aligned openings on the plates. Passages which extend through generally longitudinal sides of the ring portions are normally aligned with and blocked by the ring portions of the opposite plates. The plates are relatively slidable to move the passages outwardly relative to the opposite plates so that the terminal ends of the ring portions adjacent the passages are accessible to receive a key or the like whereupon the key may be secured on the holder by sliding it between the two overlapping ring portions to the opposite end of the ring portion on which the key is mounted, and then returning the plates to their normal aligned positions.

13 Claims, 7 Drawing Figures

FIG. 1
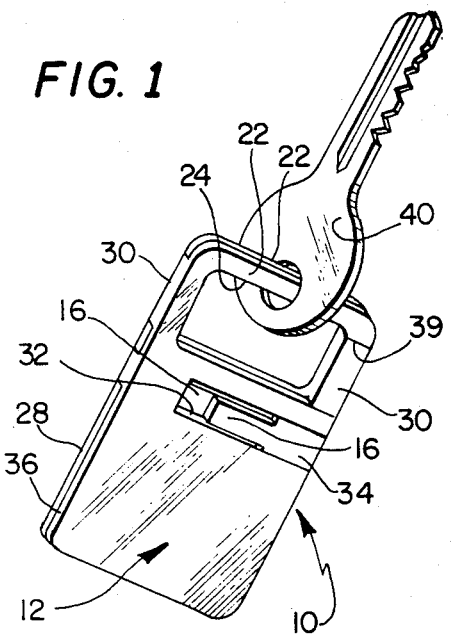
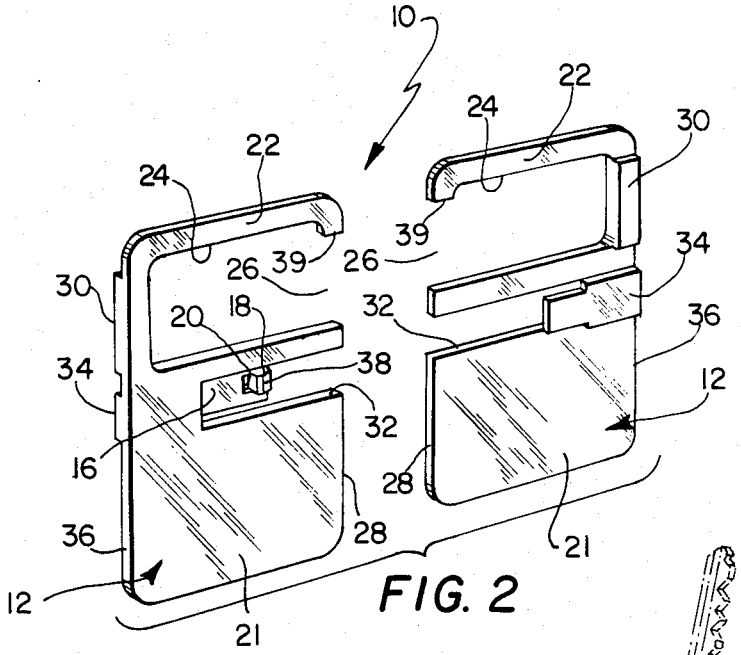
FIG. 2
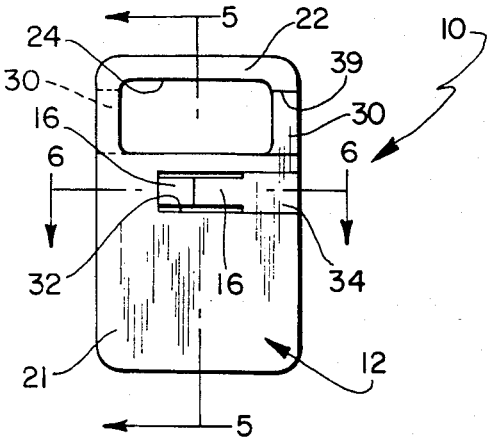
FIG. 3
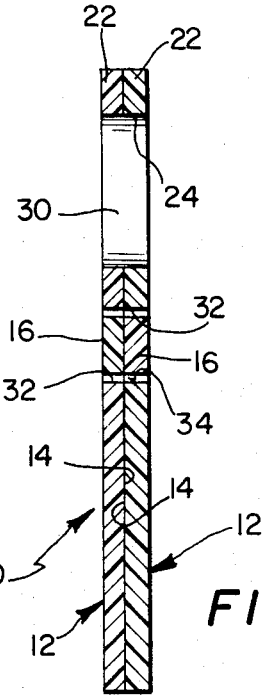
FIG. 5
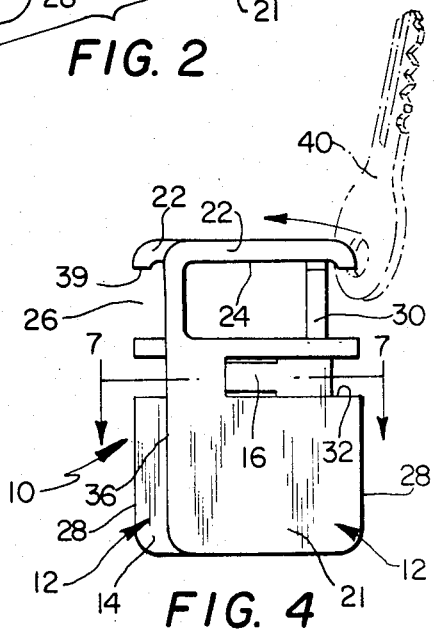
FIG. 4
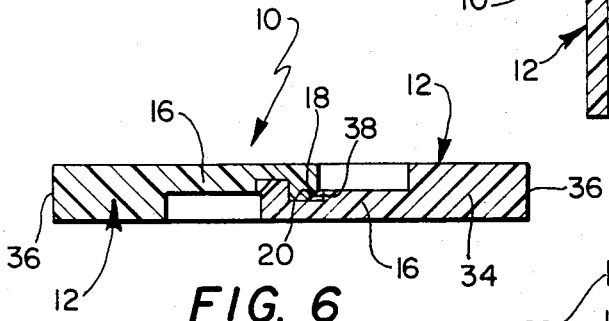
FIG. 6
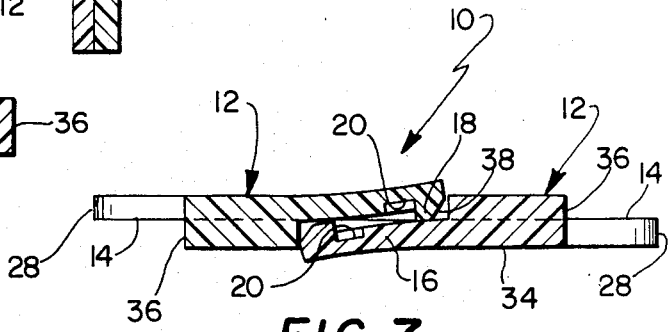
FIG. 7

ADJUSTABLE SPLIT-RING KEY TAG

BACKGROUND AND SUMMARY OF THE INVENTION

The instant invention relates to a novel construction for a holder for keys and the like.

The holder comprises a pair of substantially flat plates which are slidably interconnected in abutting face-to-face relation and which each have body portions and ring-like portions, the latter of which each have passages extending through one of the sides thereof to provide lateral access to the respective interiors thereof. The plates are relatively slidable in a lateral direction between a first position of the holder wherein the passages are aligned with the ring-like portions of the opposite plates and the remainder of the ring-like portions are in general registry, and a second position of the holder wherein the passages and the terminal ends of the ring-like portions adjacent thereto are in nonaligned relation with the opposite ring-like portions. Accordingly, when the holder is in the second position, a key or the like may be removably secured thereon by inserting one of the exposed terminal ends of the ring-like portions into the key opening and sliding the key along between the two overlapping ring-like portions to the opposite side of the holder, and thereafter sliding the plates to the first position. Preferably, the respective sides of the ring-like portions opposite the passages have thickened portions which are of substantially the same dimension as the opposite passages and which are received therein when the plates are in the first position whereby the ring-like portions of the plates cooperate to define a ring of substantially uniform thickness on the holder.

Retaining the plates in slidable abutting relation are resilient tongue members which preferably are integrally formed on the plates and which cooperate with each other as hereinafter fully described to maintain the plates in assembled relation while at the same time permitting the plates to move relative to each other to the open and closed positions on the holder.

The instant application relates to the same general subject matter as that of the applicant's copending U.S. Patent Application Ser. No. 333,667, although the holder of the instant invention differs significantly from the holder disclosed in said prior application. Specifically, the holder herein disclosed differs in the configurations of the ring-like portions of the plates and the relative position of the passages therein, as well as in the way that said ring-like portions cooperate to provide a novel and convenient means for receiving and retaining keys on the holder.

While holders for keys and the like have heretofore been available in a variety of configurations wherein one member is movable with respect to another member to open or close an opening so that keys or the like may be inserted on or removed from the holder, the instant invention also differs significantly from such prior art. The two plates of the instant holder with their respective tongue members, are preferably of identical configuration so that they can be made from the same mold for simplicity in manufacturing. The plates are normally retained in the closed position of the holder by interlocking of the tongue members to prevent accidental removal of the keys from the holder. The plates are easily movable to the open position, however, by grasping them between the thumb and forefinger and exerting a sliding force thereto to move the passages out of alignment with the opposite ring-like portions and their respective thickened portions so that the terminal ends of the ring-like portions adjacent the passages are exposed and accessible to receive keys or the like on the holder. When the holder is thereafter moved to the closed first position thereof, the passages on the opposite plates are on opposite side edges of the holder so that the ring-like portions of the plates coextend for a significant distance to provide a ring on the holder which is rigid enough to retain keys or the like, even when the plates are molded of a plastic material.

Accordingly, it is an object of the instant invention to provide a holder for keys and the like wherein a pair of identical interlocking slidable plates are alternatively slidable between open and closed positions to permit access to ring-like portions of the holder for the insertion or removal of keys.

Another object of the instant invention is to provide a holder for keys and the like wherein a pair of identical interlocking slidable plates made of a suitable plastic material are alternatively slidable between open and closed positions.

Another object of the instant invention is to provide a holder for keys and the like wherein a pair of substantially flat plates are slidably retained in abutting relation by means of integrally formed interlocking tongues whereby no extra fastening means are required to effect assembly of the plates.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 1 is a perspective view of the key holder of the instant invention in the closed position with a key thereon;

FIG. 2 is an exploded perspective view of the holder;

FIG. 3 is a side elevational view of the holder in the closed position;

FIG. 4 is a side elevational view of the holder in the open position illustrating the insertion of a key thereon;

FIG. 5 is an enlarged sectional view taken along line 5—5 in FIG. 3;

FIG. 6 is an enlarged sectional view taken along line 6—6 in FIG. 3; and FIG. 7 is an enlarged sectional view of the holder taken along line 7—7 in FIG. 4.

DESCRIPTION OF THE INVENTION

Referring now the drawing, the holder of the instant invention is generally indicated at 10 in FIGS. 1 through 7. The holder 10 generally comprises a pair of plates 12 having substantially flat inner surfaces 14 which are disposed in slidable abutting relation, a pair of integrally formed resilient tongue members 16 which are attached to the plates 12 and which cooperate to retain them in abutting relation, and interlocking teeth 18 and notches 20 on the said tongue members which cooperate as detents to releasably retain the plates 12 in their closed positions.

The plates 12 may be embodied in various configurations and may be made of any suitable rigid material.

Preferably, however, the plates 12 are molded of a rigid plastic material such as acrylic, polycarbonate, styrene or polypropylene in a generally rectangular configuration. The plates 12 include body portions 21 and ring portions 22 which define substantially rectangular openings 24. The ring portions 22 have passages 26 therethrougn which are disposed on first longitudinal edges 28 of the respective plates 12 to provide lateral access to the respective openings 24, i.e., access is gained to the openings 24 by lateral or transverse movement relative to the plates 12 through their respective passages 26. It is understood that although the ring portions 22 as herein embodied have sides which are actually longitudinal relative to the plates 12, other more generally longitudinal dispositions of the sides are possible, the important point being that the passages 26 provide lateral access to the openings 24. Thickened portions or bars 30 are provided on the sides of the respective ring portions 22 opposite from the respective passages 26 and projecting outwardly from respective surfaces 14 on the plates 12. The bars 30 are dimensioned to be received in the opposite passages 26 and are of substantially the same thickness as the opposite ring portions 22 for reasons which will be hereinafter set forth. Generally rectangular slots 32 extend transversely inwardly from the first longitudinal edges 28 and extend to points somewhat more than half way across the respective plates 12.

The tongue members 16 are disposed on their respective plates 12 in slightly outwardly offset relation to the planes of the respective surfaces 14 thereof and are integrally formed with enlarged slide members 34. The slide members 34 extend generally transversely inwardly from the second longitudinal edges 36 of the respective plates 12, which are opposite from the respective edges 28 thereof, to the inner ends of the respective slots 32, and the tongue members 16 extend inwardly therefrom to respective points beyond the longitudinal center lines of the plates 12. The teeth 18 which include outwardly bevelled edges 38 are formed on the inner sides of the tongue members 16 adjacent the terminal ends thereof and the notches 20 are disposed just inwardly of the teeth 18.

The plates 12 are assembled by positioning them in partially overlapping relation, with the surfaces 14 in abutting relation and wih the tongue members 16 of each plate in the slot 32 of the opposite plate 12. As the plates 12 are moved laterally relative to each other toward the aligned or assembled position of FIGS. 1 and 3, the slide members 34 are advanced in the slots 32 of the opposite plates 12 and the bevelled edges 38 of the opposite teeth 18 are moved into engagement with each other. Further relative sliding movement of the plates 12 causes resilient outward bending of the tongue members 16 permitting overriding of the teeth 18 into interlocking relation in the notches 20 in the opposite tongue members 16 to define the closed position of the holder 10, as illustrated in FIGS. 1, 3, 5 and 6 wherein the plates 12 are in substantially aligned overlapping relation. As is seen particularly from FIG. 6, relative sliding movement of the plates 12 to thereafter effect the separation thereof is prevented by the interlocking relation of the teeth 18 in the notches 20.

While relative sliding movement to separate the plates 12 is prevented by the interlocking relationship of the teeth 18, relative movement of the plates 12 to the open position of the holder 10 illustrated in FIGS. 4 and 7 is nevertheless possible. As will be seen, when a sliding force is applied to the plates 12 to move the tongue members 16 further into the slots 32, the bevelled edges 38 permit the passage of the teeth 18 from the notches 20 so that the teeth 18 slide along the inner surfaces of the opposite tongue members 16 until the terminal ends of the tongue members 16 engage the ends of the slots 32 as illustrated in FIGS. 4 and 7 at which point further relative sliding movement of the plates 12 is prevented.

It is further seen that relative lateral sliding of plates 12 between the open and closed positions moves the passages 26 into and out of registry with the thickened portion 30 of the opposite plate. When the plates 12 are in their closed position, the bars or thickened portions 30 are received in the opposite passages 26 so that the two ring portions 22 with the bars 30 thereof cooperate to define a ring-like loop of substantially uniform thickness. Since the passages 26 are disposed on generally longitudinal sides of the ring-like portions 22, when the plates 12 are moved to the open positions thereof, the passages 26 and the respective terminal portions 39 of the ring portions 22 adjacent thereto are moved outwardly relative to the opposite sides of the opposite ring portions 22 and the respective bars 30 thereof thereby exposing the passages 26 and said terminal portions 39. However, when the plates 12 are returned to their closed positions, they are moved substantially into alignment and the passages 26 are moved into alignment with the opposite ring portions 22 and the bars 30 are received therein. As will be noted, when the plates 12 are moved to the aligned or closed positions of FIG. 6, the teeth 18 of each plate 12 releasably snap into the notch 20 of the opposite plate 12 to releasably latch the plates 12 in their aligned or closed positions.

It is therefore seen that the instant invention provides a novel holder for keys and the like. As is illustrated in FIG. 1, one or more keys 40 may be securely retained on the holder 10 when the plates 12 are in their closed or aligned positions. The removal from or the attachment of the keys 40 to the holder 10 may be easily effected by grasping the plates 12 between the thumb and forefinger and exerting a sliding action to move them to their open or nonaligned position wherein the passages 26 and the terminal portions 39 are exposed. As illustrated in FIG. 4, when the holder 10 is in the open position, the key 40 may be inserted on one of the terminal portions 39 and thereafter forced between the two ring portions 22 causing them to be resiliently deflected outwardly until the key 40 is positioned on the thickened portion or bar 30 of the ring portion 22 on which it is received. The plates 12 may then be moved to the closed position thereof and the key 40 may then be freely moved along the continuous loop defined by the two ring portions 22 and their respective bars 30 at which point the key is captured on the holder 10. Because the loop of the holder 10 is of continuous thickness and because the passages 26 are on the opposite side edges of the holder 10, the ring portions 22 coextend for a significant distance and they cooperate to to firmly retain the key 40 on the holder 10. Accordingly, because of the simple, effective and unique cooperation between the plates 12, the holder 10 of the instant invention represents a significant improvement in the art of key holders. In addition, since the plates 12 are of identical construction, preferably of molded plastic, only a single mold is necessary thereby reducing manufacturing cost. Since the plates 12 are assembled by a simple snap interengagement of the tongues 16, no additional fastening means or sophisticated assembly operations are required, thus reducing manufacturing costs even further.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A holder for keys and the like comprising a pair of substantially flat plates, means slidably interconnecting said plates to each other in abutting face-to-face relation, said plates each having body portions and ring-like portions, a passage extending through a generally longitudinal side of each of said ring-like portions to provide a lateral access to the interiors thereof, said plates being relatively slidable in a generally lateral direction between a first position wherein the passages thereof are aligned with a part of the ring-like portions of the opposite plates and the remainders of the ring-like portions are in general alignment, and a second position wherein the passages thereof and the terminal portions of the respective ring-like portions adjacent thereto are disposed outwardly of the opposite ring-like portions whereby a key or the like may be removably secured on said holder by inserting one of said terminal portions into the key opening and sliding the key along the respective ring-like portion to the opposite side thereof and thereafter sliding said plates to said first position.

2. In the holder of claim 1, the sides of said ring-like portions opposite the respective passages each having thickened portions which are of substantially the same dimension as the opposite passages and are received therein when said plates are in said first position so that said ring-like portions cooperate to define a ring on said holder of substantially uniform thickness.

3. In the holder of claims 1 or 2, said plates being of substantially the same configuration.

4. In the holder of claims 1 or 2, said plates being of molded plastic, each plate being identical to the other.

5. In the holder of claim 1, said interconnecting means comprising resilient integrally struck tongue members on each plate, said tongue members resiliently overlapping each other to maintain said plates slidably assembled to each other.

6. In the holder of claim 5, said tongue members having detent means for releasably maintaining said plates in said first position.

7. In the holder of claim 5, means cooperating with said tongue members for preventing relative sliding movement of said plates beyond said first and second positions.

8. The holder of claim 5, further comprising means of guiding said plates in their relative sliding movement.

9. In the holder of claim 8, said plates having elongated slots therein, said guide means comprising elongated slide members dimensioned to be slidingly received in said slots and traveling in the slots of the opposite plates to thereby guide said plates in their sliding movement.

10. In the holder of claim 9, said slide members extending integrally in aligned relation from said tongue members, said slots extending along the tongue members of their respective plates and a distance therebeyond whereby said tongue members also travel in the slots in the opposite plates.

11. In the holder of claim 5, said plates and their respective tongue members being of unitary construction and made of a rigid plastic material.

12. In the holder of claim 10, the terminal ends of said tongue members engaging the opposite plates in the respective slots thereof at the base of the tongue members of said opposite plates and thereby preventing relative sliding movement of said plates beyond said second position.

13. In the holder of claim 7, said plates having elongated slots therein which extend along the respective tongue members thereof, said tongue members traveling in the slots of the opposite plates with the terminal ends of said tongue members engaging the opposite plates in the respective slots thereof at the bases of the respective tongue members thereof to prevent relative sliding movement of said plates beyond said second position, said tongue members having detent means on the overlapping surfaces thereof which releasably engage to maintain said plates in said first position and prevent sliding movement thereof beyond said first position.

* * * * *